United States Patent [19]

Kovacik

[11] 4,236,195

[45] Nov. 25, 1980

[54] LIGHT GUARD

[75] Inventor: James W. Kovacik, Parma, Ohio

[73] Assignee: Alert Safety Lite Products Company, Bedford Heights, Ohio

[21] Appl. No.: 24,617

[22] Filed: Mar. 28, 1979

[51] Int. Cl.[3] ..... F21V 15/00

[52] U.S. Cl. ..... 362/376; 362/377; 362/396; 362/399; 362/400

[58] Field of Search ..... 362/376, 377, 396, 400, 362/296, 399

[56] References Cited

U.S. PATENT DOCUMENTS

| | | | |
|---|---|---|---|
| D. 240,157 | 1/1976 | Darn | D48/16 B |
| 2,510,708 | 6/1950 | Marshall | 362/376 |
| 2,640,147 | 5/1953 | Suchein | 362/376 |
| 2,717,308 | 9/1955 | Kevorkian | 362/376 |
| 3,119,568 | 1/1964 | Broder | 362/376 |
| 3,814,927 | 6/1974 | Buzza | 362/376 |
| 3,819,930 | 6/1974 | Lamont | 362/376 |
| 3,935,560 | 1/1976 | Darn | 362/376 |
| 4,086,482 | 4/1978 | Torgerson | 362/376 |

*Primary Examiner*—Benjamin R. Padgett
*Assistant Examiner*—J. L. Barr
*Attorney, Agent, or Firm*—Wilson, Fraser, Barker & Clemens

[57] ABSTRACT

A light guard is disclosed adapted to enclose a lamp and the like comprising a reflector section and a cage section which are preferably molded from electrically non-conducting synthetic resins. The light guard is characterized by the manner of detachably securing the two sections together, both for relative pivoting with respect to each other and for latching together. The pivoting structure includes a shaft and slotted sleeve for easy assembly and disassembly and optionally has restraining means to limit free pivotal opening of the sections without preventing further pivoting totally to disengage the sections from each other. The latching structure includes a slotted flange on one section and flexible fingers on the other section to engage frictionally and resiliently within and adjacent to the ends of the slot to lock the sections together.

13 Claims, 7 Drawing Figures

LIGHT GUARD

BACKGROUND OF THE INVENTION

Light guards have been used for many years to house a lamp, such as an incandescent light bulb, connected to an electric power source through a socket often carried by the lamp guard itself. As such, the light guard may be mounted over building exits and the like. The light guard may also be made portable by connecting the lamp to an extension cord in order to carry the lamp to poorly lit areas. These light guards are often termed trouble lamps and are commonly employed by mechanics and other workers who require a concentration of light in a frequently changing location. Usually the light guard has two sections which may be separated from each other to replace a burned-out lamp, clean the guard, or for still other purposes.

In general, the sections comprise a reflector or shield section and a cage section. As a rule, the reflector section partially encircles the lamp and provides a reflective surface while also serving as a shield for the eyes of a user when it is placed between him and an object being illuminated. The cage section is relatively open so as to pass the light from the lamp with minimum interference.

It has been the practice to fabricate the light guard entirely from metal. The cage section, for example, often comprises a simple wire cage structure. While light guards of metal can withstand substantial heat created by the lamps, they are considered by some a safety hazard due to their electrical conductivity and the resulting possibility of electrical shocks or burns to a user. To meet certain safety standards, metal light guards may have to be grounded to reduce the possibility of shock hazard. In more recent years, the trend has been to mold the sections of a light guard from electrically non-conducting synthetic resins. Such resins are less expensive than metal, and plastic light guards substantially reduce the likelihood of electrical shocks and heat burns.

Whether fabricated from metal or snythetic plastics, light guards desirably are constructed to avoid easy unlatching which would augment the hazards of electrical shocks and heat burns from the lamp. Construction designed to avoid easy unlatching includes not only structure specifically designed for locking and unlocking the reflector and cage sections with respect to each other, but also structure designed for pivoting or other relative movement between the sections. However, if a light guard is designed to avoid accidental or inadvertent easy opening or detachment, it often results that the guard is also difficult to open manually when it is desired to unlatch or otherwise separate the reflector and cage sections from each other.

SUMMARY OF THE INVENTION

A principal object of the present invention is to provide a light guard of improved construction having two complimentary sections which are sufficiently secured together to resist accidental or unwanted unlatching or disassembly and yet which can, when desired, be easily manually unlatched or disassembled by a user. Related objects are to provide such a light guard fabricated from electrically non-conducting synthetic resins or plastics, and to provide a light guard that is relatively simple and inexpensive in construction but still strong and durable in use.

In referring to resistance to accidental unlatching or disassembly of the two sections while yet possessing facile manual unlatching or disassembly when desired, I include latching and unlatching functions which lock or unlock the sections, to pivotal or other movement relative to each other, and as well as to complete bodily separation and re-joining of the two sections, all as hereinafter more fully described.

In one form, the present light guard comprises two generally complementary sections, including reflector and cage sections, having peripheral portions adapted to face each other for a substantial extent along such portions and thereby together define an enclosure for a lamp and the like. The light guard includes means for detachably securing the sections together which comprises (a) latch means at one of such facing peripheral portions of the sections temporarily to secure the sections together, and (b) hinge means at another of such facing peripheral portions to pivot the sections relatively to each other.

In a preferred form, the latch means comprises a slotted flange extending longitudinally along one of sections and finger means extending from the other of the sections adapted to catch within and adjacent the ends of the slot of the flange upon pivoting the sections together to form the enclosure. The hinge means preferably comprises a stub shaft supported by and spaced from a peripheral portion of one of the sections to leave a gap between the stub shaft and the peripheral portion. The peripheral portion of the other of the two sections facing the peripheral portion having the stub shaft has slotted sleeve means adapted to pass through the gap and make a rotatable snap fit with the stub shaft. The slotted sleeve means has retaining means adapted to engage one of the sections upon relative pivoting between the sections to restrain but not necessarily prevent further relative movement of the two sections resulting in their complete separation.

The two sections are preferably substantially semi-circular intermediate their ends such that the peripheral portions of each section may contact each other at least along the semi-circular configurations to define an enclosure. One section is a reflector and the other is a cage section with both sections having opposite lower ends which converge toward each other and terminate in means for engaging a socket holder or the like.

DESCRIPTION OF THE PREFERRED EMBODIMENTS

In one form, the light guard comprises two generally complementary half sections which butt together to form an enclosure for a lamp and the like. In the illustrated form, the sections are semi-circular shells with substantially flat planar peripheries which face and abut against one another. The means for mounting the two sections together guards against accidental or unwanted unlatching or disassembly, while easily permitting manual latching and unlatching or assembly and disassembly when desired. The mounting means includes both structure for locking and unlocking the sections together, and structure for pivoting the sections relatively to each other while accommodating repeated complete separation or disassembly as well as assembly of the two sections.

Figure 4:
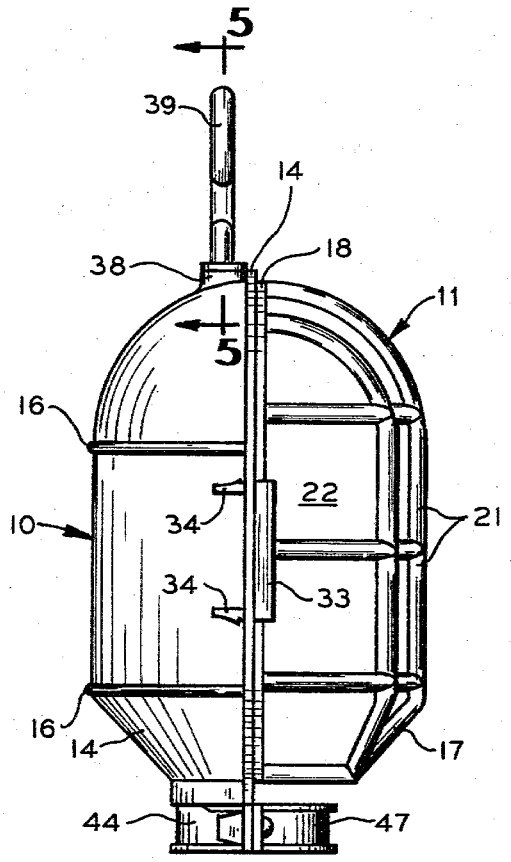
FIG. 4 is a side elevational view of the light guard of FIG. 2 and shows the sections when pivoted to a latched position.

More particularly, referring to the drawing, the illustrated embodiment includes a reflector section generally represented at 10 and a cage section generally indicated at 11. Reflector section 10 is semi-circular intermediate its ends with a rounded upper end 12 and a truncated semi-conical lower end 13. Section 10 has a substantially flat periphery 14 that is continuous and co-planar throughout that side of reflector section 10 which faces cage section 11 in the closed position, as shown by FIG. 4, except for a gap across the semi-circular opening 15 (FIG. 2) adjacent the bottom of section 10. The interior of reflector section 10 is solid and concave to perform its reflecting function. The exterior may have reinforcing ribs 16 (FIG. 4) molded or otherwise formed directly with section 10.

Cage section 11 is also semi-circular intermediate its ends with a rounded upper end 16 which in cooperation with end 12 of section 10 forms a dome or semi-spherical top. Section 11 also has a truncated semi-conical lower end 17 which converges toward semi-conical end 13 of section 10, and a substantially flat periphery 18 that is continuous and coplanar throughout that side of cage section 11 which faces periphery 14 of reflector section 10 in the closed position, as shown by FIG. 4, except for a gap across a semi-circular opening 20 adjacent the bottom of section 11. Cage section 11 has an open network or cage appearance formed by intersecting vertically and horizontally disposed ribs 21 as viewed in FIG. 2. The ribs leave relatively large openings 22, which emit light from a lamp within the enclosure formed by the sections. Ribs 21 can be directly formed in section 11, especially when the section is molded from an electrically non-conductive synthetic resin.

Referring next to the construction for securing sections 10 and 11 together, both as to mounting the sections with respect to each other for relative pivoting and for assembly and disassembly, and as to detachably latching and unlatching the sections together, such construction is particularly designed to prevent accidental or unwanted operation while easily accommodating such operation when desired. The described construction includes cooperating hinge means at one facing or contacting peripheral portions of sections 10 and 11, and latching means at another of the facing or contacting peripheral portions of the sections.

Figure 2:
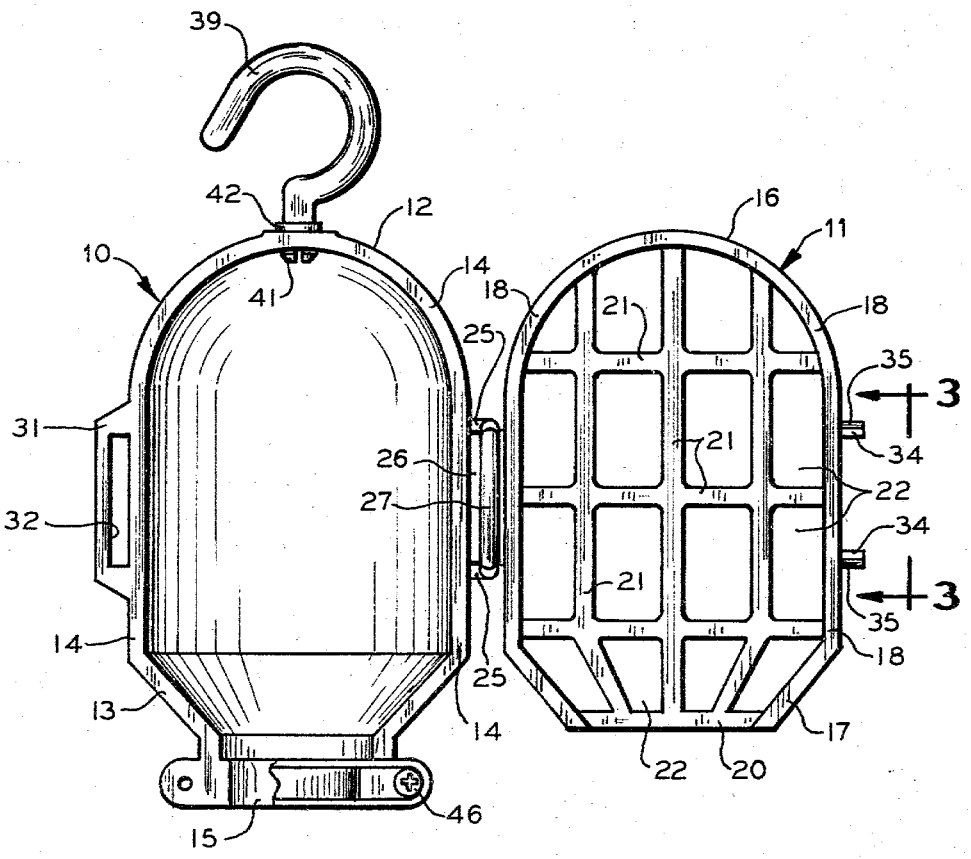
FIG. 2 is a side elevational view of the light guard of FIG. 1 and illustrates the two sections when pivoted relatively to each other to an open position.
Figure 7:
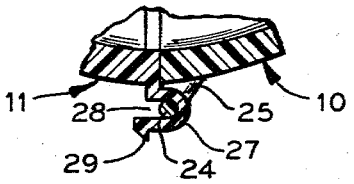
FIG. 7 is an enlarged, fragmentary section of FIG. 6 on the line 7—7.
Figure 6:
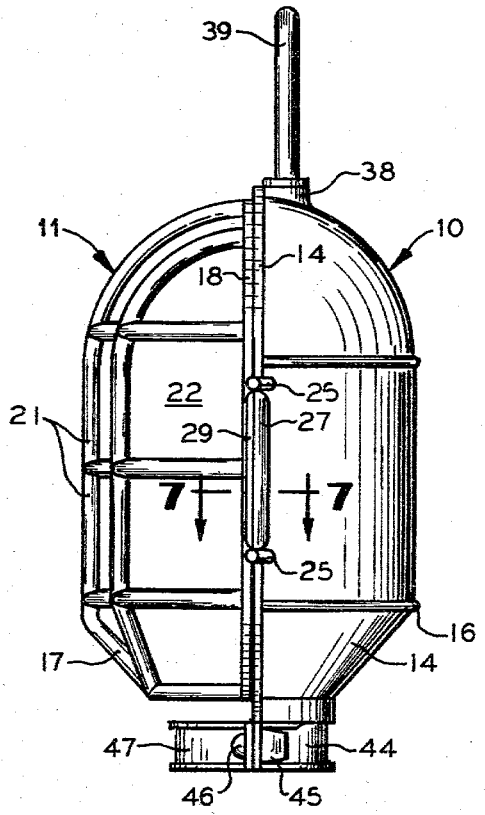
FIG. 6 is a side elevational view of the light guard opposite to that of FIG. 4 and illustrates the pivotal hinge construction.

The hinge construction is best shown by FIGS. 2, 6 and 7. Reflector section 10 has a stub shaft 24 which is supported by and spaced from periphery 14 by a pair of tabs 25 fixed to the ends of shaft 24 and section 10. The shaft is spaced laterally away from periphery 14 so as to leave a gap 26 between section 10 and the shaft. Cage section 11 has a sleeve 27 similarly spaced laterally from its periphery 18 opposite to that portion of periphery 14 of section 10 having the stub shaft. Sleeve 27 has a longitudinally extending slot 28 (FIG. 7) and an outwardly directed restraining flange 29.

Figure 1:
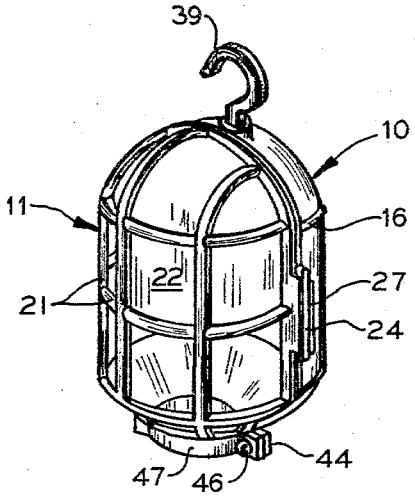
FIG. 1 is a perspective view of a present light guard.
Figure 3:
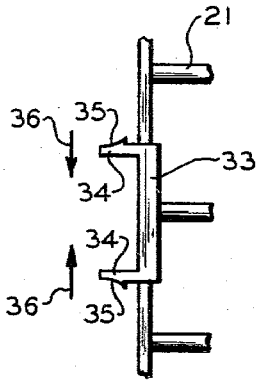
FIG. 3 is an enlarged, fragmentary section of FIG. 2 on the plane of the line 3—3.

The latching construction is best shown by FIGS. 2, 3 and 4. This construction is formed on corresponding, facing peripheral portions 14 and 18 of sections 10 and 11, respectively, on the opposite sides of the sections to those having the hinge means. Section 10 has a laterally extending flange 31 provided with a longitudinally extending slot 32. The periphery 18 of section 11 at a portion opposte to the slotted flange 31 is widened for strength to form a strip 33. Each end of strip 33 has a circumferentially extending finger 34 pointed toward slotted flange 31. The remote sides of each finger 34 has a camming surface 35 defining a catch.

The assembly and disassembly of sections 10 and 11, their relative pivoting, and their latching and unlatching may be simply carried out in the folowing manner. It is noted that whether the light guard sections are fabricated from metal or plastic, the natural resiliency and flexibility of those materials aid in achieving the action sought. With the sections disassembled, sleeve 27 of section 11 is passed through gap 26 between stub shaft 24 and the reflector section and its slot 28 forced onto the shaft, until sleeve 27 makes a snap fit around the shaft. The sleeve and shaft have a relatively tight fit but not so tight as to interfere with relative rotation between the sections. Thereafter, the two sections easily pivot with respect to each other with shaft 24 as the axis of rotation.

To latch the sections together, they are pivoted toward one another. Fingers 34 pass through slot 32 of flange 31 and engage the flange adjacent the opposed ends of the slot. In the preferred action, camming surfaces 35 of the fingers ride beneath the opposite ends of slot 32. This action forces fingers 34 toward one another until camming surfaces 35 have cleared slot 32. Then the fingers snap back into a more nearly parallel position with respect to each other, and the catches formed from camming surfaces 35 firmly grip the obverse side of flange 31 as shown in FIG. 4.

To unlatch the sections, one need merely grip the remote sides of fingers 34, as by the thumb and forefinger, and push the fingers toward each other in the direction of arrows 36. Although the fingers hold the sections tightly together, only a slight movement in the direction of arrows 36 is needed to dislodge camming surfaces 35 away from the ends of slot 32 and permit the fingers to retreat through the slot as sections 10 and 11 pivot about shaft 24 as an axis to an open position, such as that illustrated in FIG. 2.

Other pivoting to this open position is enough to reach the interior of the light guard to replace a burned-out lamp or perform other functions, so that it is not necessary completely to separate the sections. During this time, restraining flange 29 on slotted sleeve 27 is engagable with reflector section 10, and gently restrains further open pivoting of the sections. However, it is sometimes necessary or desirable completely to separate sections 10 and 11 as for cleaning or repair. This can still be accomplished with the present construction by forcing the sections further about stub shaft 24 against the resistance of restraining flange 29. Because of its elastic nature, flange 29 on sleeve 27 flexes and snaps past periphery 14 and upon further pivoting of the sections in an opening direction. After restraining flange 29 clears periphery 14, the slotted flange 27 is easily pulled free of stub shaft 24 and the two sections are completely separated.

The light guard may include still other structural features adapted to equip the guard for other functions. As examples, the light guard may include hook means by which to support it at a work site and may also be shaped to receive and support a socket holder for a lamp.

Figure 5:
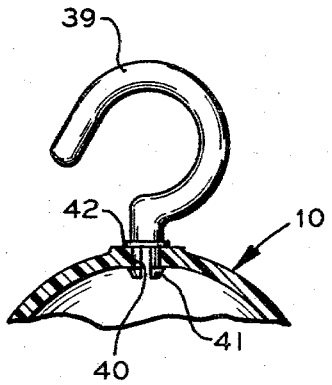
FIG. 5 is an enlarged, fragmentary section of FIG. 4 on the line 5—5.

In the illustrated embodiment, the semi-spherical top of the enclosure formed by the two sections has a boss 38 provided with a central aperture. A hollow hook 89 has an inner split ends 40 (FIG. 5) provided with an integral annular flange 41 and an integral washer 42 spaced from the split end. In use split ends 40 are pressed together to pass them through the aperture of boss 38 for a distance up to integral flange 42 which acts as a stop. By design, this distance is sufficient to permit the annular flange 41 of the split ends to spring radially outwardly and engage the underside of the semi-spherical top. This prevents withdrawal of hook 39, although it is free to act as a swivel hook and rotate 360° about the split ends 40 as an axis, so that hook 39 may be rotatably positioned as desired. Alternatively, split ends 41 may be held in place with a fastener which threadably engages the split end.

The truncated, semi-conical bottom ends 13 and 17 of sections 10 and 11, respectively, merge toward each other to form a truncated, full conical bottom for the light-guard. Reflector section 10 extends below section 11 and terminates in a flanged, semi-circular clamping band 44 having an integral stud 45 at each end. Each stud has a blind bore (not shown) sized to receive a self-threading screw. Such screws 46 pass through openings at the ends of a semi-circular clamping band 47, not otherwise attached to the light guard, and threadably engage the bores of studs 45 of fixed band 44. In this manner, clamping bands 44 and 47 form a holder adapted to embrace a lamp socket into which an incandescent light bulb or the like may be threadably secured. The lamp socket holder may comprise a conventional socket-handle assembly normally used with trouble lights or extension cords. Alternatively, the lamp socket holder may comprise a holder that is conventionally mounted adjacent a door opening to provide a service or night light. In this case, of course, the hook 39 is not needed. In place of self-threading screw 46, standard nuts and bolts may also be used.

While the described parts of the present light guard can be fabricated from metal, it is preferred to mold them from electrically non-conducting synthetic resins that are substantially rigid to resist external forces applied to the light guard and that also have heat resistant characteristics that prevent breakdown of the synthetic resin when a burning lamp is enclosed within the reflector and cage sections. Plastic materials derived from petrochemicals have been found to be suited for this purpose. Specific resins that may be used include polypropylene, polycarbonates, nylon, cross-linked thermosetting polyester resins, and the like. If desired, the synthetic resin may be reinforced as with glass fibers.

Although the foregoing describes several embodiments of the present invention, it is understood that the invention may be practiced in still other forms within the scope of the following claims.

I claim:

1. A light guard comprising two generally complementary sections having peripheral portions adapted to face each other for a substantial extent along said portions to define an enclosure for a lamp and the like, means for detachably securing said sections together including hinge means at one such facing peripheral portions of said sections to pivot the sections relatively to each other, and latch means at another of such facing peripheral portions temporarily to secure said sections together, said latch means comprising catch means extending outwardly from a plurality of points along a peripheral portion of one of said sections, and finger means on a peripheral portion of the other section for each of said catch means adapted to engage said catch means upon pivoting the sections together to form said enclosure, said finger means for each of said catch means being movable toward one another to release said engagement of finger means and catch means.

2. A light guard of claim 1 in which each section is substantially semi-circular intermediate its ends, said peripheral portions of each section contact each other at least along said semi-circular configurations, said hinge means is at one contacting peripheral portions of the two sections, and said latch means is at the other contacting peripheral portions of the two sections.

3. A light guard of claim 2 in which one of the sections is a reflector section and has an inside concave surface, and the other of said sections is a cage section having openings through which to emit light.

4. A light guard of claim 1 in which said sections comprise an electrically non-conducting synthetic resin.

5. A light guard of claim 1 in which said hinge means comprises shaft means supported by and spaced from one of said sections, and slotted sleeve means on the other one of said sections adapted to rotatably engage said shaft means.

6. A light guard of claim 1 in which said hinge means comprises a stub shaft supported by and spaced from a peripheral portion of one of said sections to leave a gap between the stub shaft and said peripheral portion, and slotted sleeve means on a peripheral portion of the other of said sections facing said first-mentioned peripheral portion and adapted to pass through said gap and make a rotatable snap fit with said stub shaft, said slotted sleeve means having restraining means adapted to engage said one of said sections upon relative pivoting between the sections to restrain further relative movement.

7. A light guard of claim 1 in which said latch means comprises a slotted flange extending longitudinally along one of said sections, and finger means extending from the other of said sections and adapted to catch within and adjacent to the ends of the slot of said flange upon pivoting said sections together to form said enclosure.

8. A light guard of two generally complementary sections defining in assembly an enclosure to house a lamp and the like, comprising:

(a) a reflector section substantially semi-circular intermediate its ends and having an inside essentially concave surface and a periphery, (b) a cage section substantially semi-circular intermediate its ends having openings through which to emit light and a periphery substantially matching the periphery of said reflector section at least at the semi-circular configurations to nest one section against the other and thereby define said enclosure, and (c) means for detachably securing the two sections together, comprising in combination:

(1) hinge means including shaft means supported by and spaced from a periphery of one of said sections, and slotted sleeve means on a periphery of the other of said sections adjacent to the previously mentioned periphery adapted to rotatably engage said shaft means, and (2) latch means positioned on peripheries of the sections oppositely to said hinge means and including a slotted flange extending longitudinally along a periphery of one of said sections, and finger means extending circumferentially from the other of said sections and adapted to catch within and adjacent to the ends of the slot of said slotted flange, said finger means being movable toward one another to release the finger means from adjacent said ends of the slot of said flange.

9. A light guard of claim 8 in which said sections have substantially matching, rounded ends to form an essentially semi-spherical top, and in which said sections have converging opposite ends terminating in means for engaging a socket holder or the like.

10. A light guard of claim 8 in which said sections comprise an electrically non-conducting synthetic resin.

11. A light guard of claim 8 in which said hinge means comprises a stub shaft supported by and spaced from said periphery to leave a gap between it and said periphery, and said slotted sleeve means is adapted to pass through said gap and make a rotatable snap fit with said stub shaft, said slotted sleeve means having a flange extending along the sleeve adapted to engage said one of said sections upon relative pivoting between the sections to act as a stop and restrain further relative movement without preventing complete separation of said shaft means and sleeve means.

12. A light guard of claim 8 in which said reflector section has said shaft means and said slotted flange, and said cage section has said slotted sleeve means and said finger means.

13. A light guard of claim 8 in which one of said sections has hook means to support the light guard.

* * * * *